United States Patent [19]

Tanbara

[11] Patent Number: 5,011,583

[45] Date of Patent: Apr. 30, 1991

[54] CORROSION PREVENTION FOR A MARINE PROPULSION SYSTEM

[75] Inventor: Hiroaki Tanbara, Hamamatsu, Japan

[73] Assignee: Sanshin Kogyo Kabushiki Kaisha, Hamamatsu, Japan

[21] Appl. No.: 497,969

[22] Filed: Mar. 23, 1990

[30] Foreign Application Priority Data

Mar. 31, 1989 [JP] Japan ..... 1-81300

[51] Int. Cl.[5] ..... B63H 5/06; C23F 13/00

[52] U.S. Cl. ..... 204/148; 114/221 R; 114/270; 204/197; 416/146 R; 416/244 B; 440/76; 440/78; 440/113

[58] Field of Search ..... 204/147, 148, 196, 197; 114/221 R, 270; 440/113, 49, 76, 78; 416/146 R, 244 B

[56] References Cited

U.S. PATENT DOCUMENTS

| | | | |
|---|---|---|---|
| 1,216,549 | 2/1917 | Davis | 204/197 |
| 2,067,839 | 1/1937 | Godfrey | 204/197 |
| 3,169,105 | 2/1965 | Preiser et al. | 204/196 |
| 3,240,180 | 3/1966 | Byrd | 204/196 |
| 4,146,448 | 3/1979 | Nakano et al. | 204/197 |
| 4,549,949 | 10/1985 | Guinn | 204/197 |
| 4,604,068 | 8/1986 | Guinn | 204/147 |

FOREIGN PATENT DOCUMENTS 63-100187 10/1986 Japan .

*Primary Examiner*—T. Tung

*Attorney, Agent, or Firm*—Berman, Aisenberg & Platt

[57] ABSTRACT

A marine propulsion system of the type having a sacrificial anode for corrosion protection of the casing includes structure whereby the propeller is electrically insulated from the casing and the sacrificial anode. The structure includes spacers made of insulating materials, spacers having insulating coatings, or insulating coatings on the surfaces of the propeller or the propeller shaft. Electrical insulation of the propeller prevents unsightly and efficiency-reducing depositions on the propeller surfaces and reduces the required size of the anode.

9 Claims, 2 Drawing Sheets

CORROSION PREVENTION FOR A MARINE PROPULSION SYSTEM

TECHNICAL FIELD

This invention relates to the art of marine propulsion systems and, in particular, is an arrangement for preventing deposition of a corrosion preventing anode on selected parts of such a system.

BACKGROUND ART

The tendency of a metallic structure to corrode in a marine environment is known. This corrosion is caused primarily by an electrochemical or chemical reaction between the metal and the water. The corrosion is particularly acute when the system is operated in salt water.

A known system for prevention of corrosion of a marine system includes a sacrificial anode which is electrically connected to the propulsion system and is in contact with the water. This anode is typically made of zinc, and occupies a position in the Galvanic series with respect to the material of the propulsion system to be protected (e.g., an aluminum alloy) such that the parts of the propulsion system to be protected become cathodes. The material of the sacrificial anode dissolves into the water and is then deposited on the material of the propulsion system.

An example of such a system utilizing such a sacrificial anode is disclosed in unexamined Japanese application 63-100187.

A significant problem with systems using a sacrificial anode is that the material of the anode is deposited on the surface of the protected system. In the case of a marine propulsion system with a propeller having a shiny surface, for example one made of stainless steel, these deposits are unsightly and detract from its efficiency.

In addition, when the propulsion system to be protected is large, the amount of material to be protected becomes large, and the sacrificial anode must be accordingly large. Moreover, the protection of the material of the system becomes more difficult as the distance from the sacrificial anode increases.

SUMMARY OF THE INVENTION

In accordance with the invention, a selected element of a marine propulsion system which employs a sacrificial anode for cathodic protection against corrosion is electrically insulated from the remainder of the material of the propulsion system. In the preferred embodiment, the selected element is the propeller.

In the preferred construction, a rubber damper fits between a splined member engaging the propeller shaft and an inner cylinder of the propeller. The propeller does not come into electrical contact with the shaft or the splined member, except for possibly a brief time during high thrust of the propeller, the deposition of anodic material on the propeller during this brief interval being insignificant.

In additional embodiments, an insulating material is placed between the propeller and the remainder of the propulsion system. A variety of insulating materials may be used, and a preferred material is stainless steel with an insulating ceramic coating. Alternatively, the insulating material may be a reinforced resin if the power requirements of the propulsion system are such that the resin will be of adequate strength.

An alternative construction is to use a propeller shaft constructed of an insulating material or one having a insulating coating.

The construction according to the invention, which electrically insulates the propeller from the electric circuit comprising the sacrificial anode and the casing of the propulsion system, prevents deposition of unsightly anodic material on the propeller. In addition, the removal of a selected part of the propulsion system by the construction according to the invention permits the sacrificial anode to be smaller.

The primary object of this invention is to maintain the surface of a propeller of a propulsion system using cathodic protection free of deposits of anodic material.

Another object of this invention is to reduce the required size of a sacrificial anode in a marine propulsion system with cathodic protection.

DETAILED DESCRIPTION OF THE PREFERRED EMBODIMENT

Figure 1:
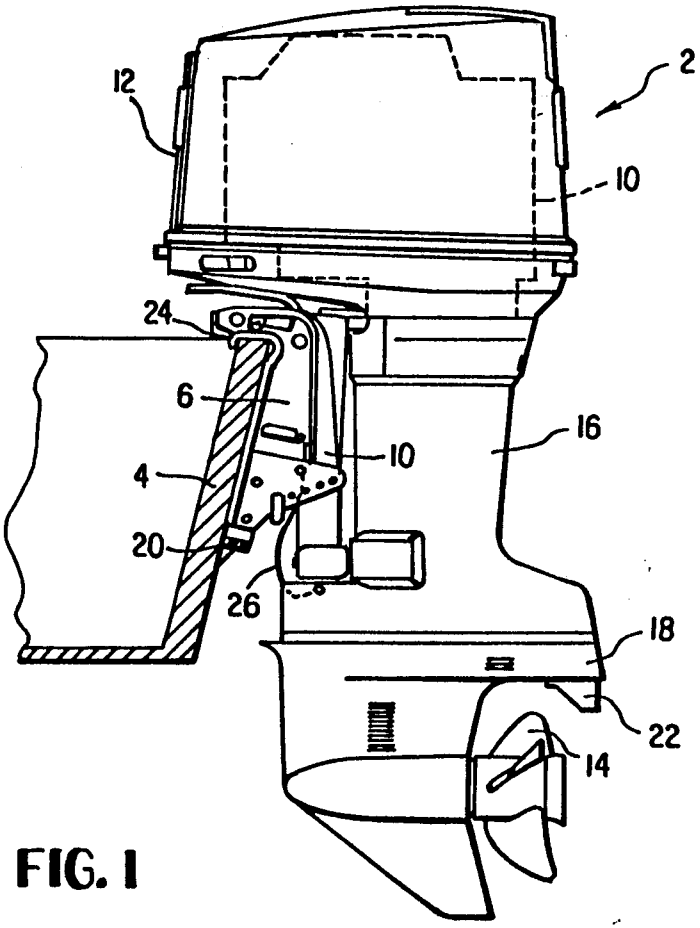
FIG. 1 is a side view of an outboard motor in accordance with the invention showing a boat hull in cross section.

With reference to FIG. 1, an outboard motor 2 is attached to the transom 4 of a boat by a clamp 6. The clamp 6 includes a swivel bracket 8 which allows the motor to be raised and lowered. An engine 10 is covered by a cowling 12, and the engine drives a propeller 14 by way of a gearing system housed in an upper casing 16 and a lower casing 18. A first sacrificial anode 20 is attached to the clamp 6, and a second sacrificial anode 22 is attached to the lower casing 18. The second anode may be in the form of a trim tab, as is known in the art.

The sacrificial anodes 20 and 22 are typically made of zinc and electrically make the upper and lower casings 16 and 18 cathodes to prevent their decomposition. Leads 24 and 26 electrically connect, respectively, the swivel and clamp brackets, and the clamp bracket and upper casing to complete the electrical circuit between the parts to be protected by the anodes.

Figure 3:
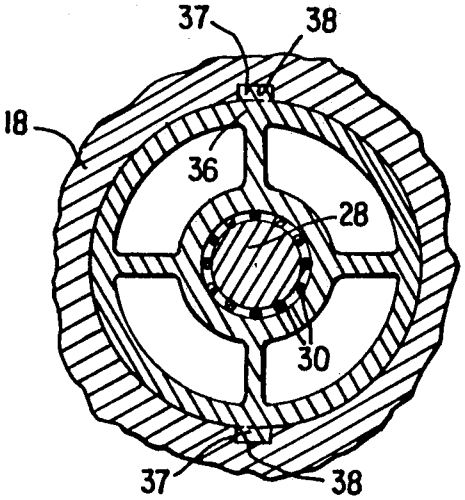
FIG. 3 is a cross section taken along line 3—3 of FIG. 2.
Figure 4:
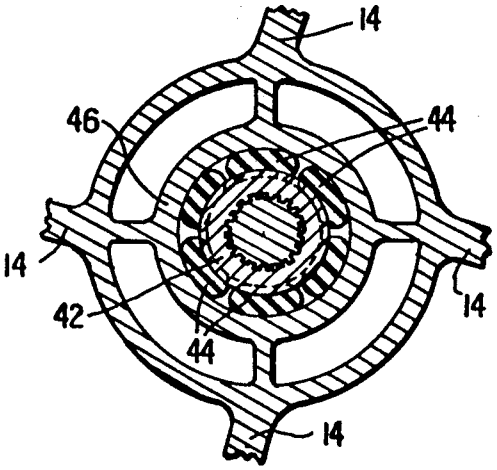
FIG. 4 is a cross section taken along line 4—4 of FIG. 2.
Figure 2:
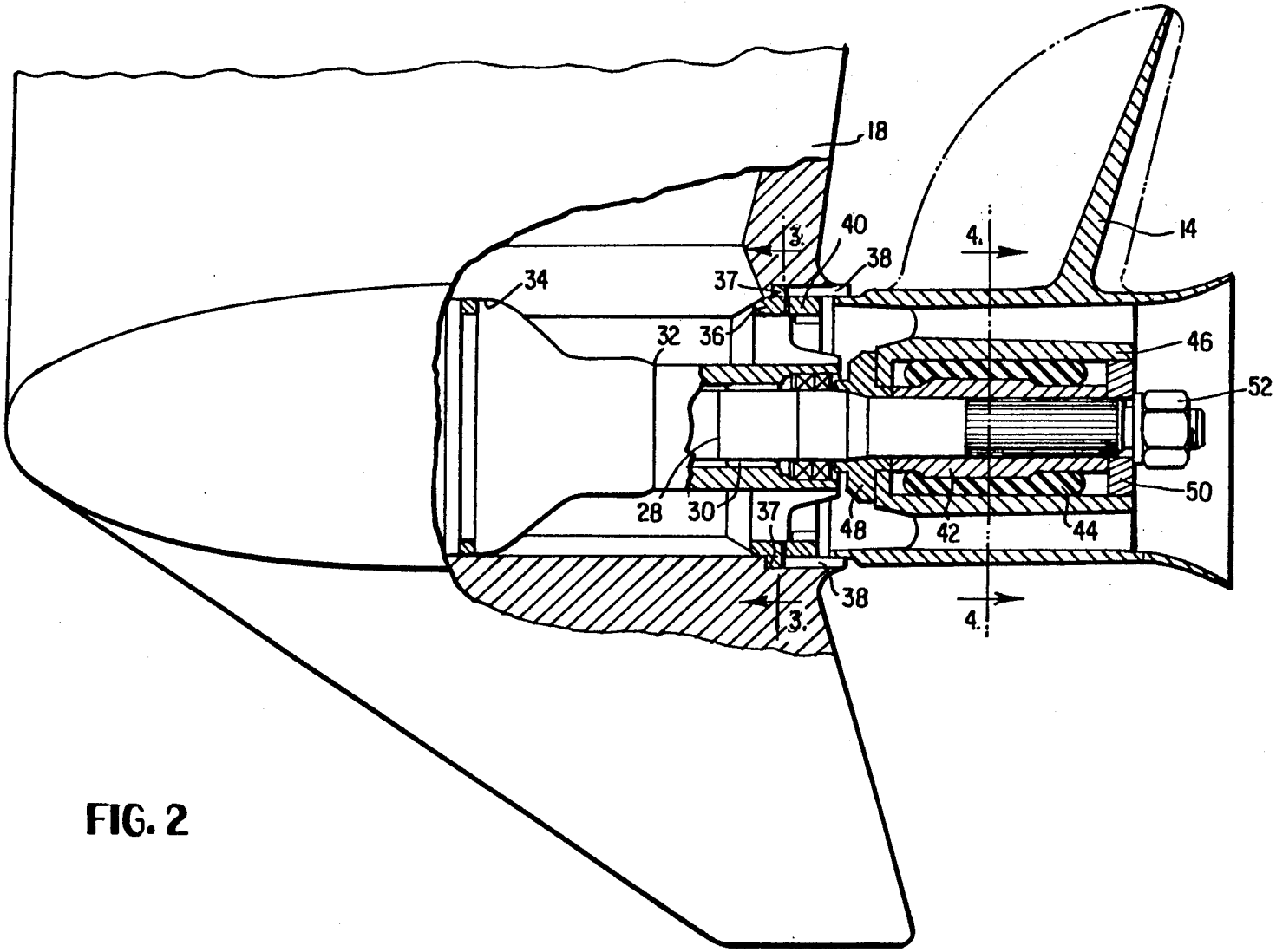
FIG. 2 is a side view of the propeller section of the motor shown in FIG. 1 in partial cross section.

With reference to FIG. 2, the propeller 14 is mounted on a propeller shaft 28, which is in part supported by a bearing 30 and driven by a gearing system (not shown). Bearing 30 is held in a bearing housing 32, and an O-ring seal protects the gearing system from water. The rear of the housing 32 comprises an annular element 36 which is integral therewith. The annular element 36 has projections 37 which are received in key slots 38, as shown in more detail in FIG. 3. A ring nut 40 is removably held to the casing 18, for example by screw threads, to secure the annular element 36 to the housing. It should be noted that the inner surface of the casing 18 including the groove 38 does not contact the outer surface of the propeller, there being a small clearance between the two.

A cylindrical body 42 includes splines which engage the splines on propeller shaft 28. A number of rubber dampers 44 fit between the cylindrical body 42 and the inner cylinder 46 of the propeller to secure the propeller to the cylindrical body 42. A first spacer 48 fits between the inner cylinder of the propeller and the bearing housing 32 and engages a tapered part of the propeller shaft to receive the thrust from the propeller. A nut 52 secures the cylindrical body 42 and the spacer 48 to the shaft, and a washer 50 is placed between the cylindrical body 42 and the nut 52. The spacer 48 does not ordinarily contact the inner cylinder 46, a clearance being maintained to prevent electrical contact between the propeller and the shaft. Contact may be made, however, during periods of high thrust, but the duration of this contact is short, and no significant deposition of anodic material takes place. The washer 50 is similarly spaced from the inner cylinder 46.

Spacer 48 and washer 50 may also be made of insulating materials to ensure the electrical insulation of the propeller from the remainder of the propulsion system even if the parts should come into contact during acceleration. Elements 48 and 50 may be made of a conducting material and the surfaces coated with an insulating material, such as an insulating ceramic.

The inner surface of the inner cylinder 46 may be coated with an insulating material, such as a ceramic, to further insulate the propeller from the shaft. Another alternative is to coat the outer surface of the propeller shaft with such an insulating coating.

It will be appreciated that a system has been described wherein the surface of a propeller is maintained in a polished state by insulating the propeller from the remainder of the propulsion system which prevents deposition of anodic material on the propeller. Moreover, the described system permits the use of smaller sacrificial anodes.

Modifications within the scope of the appended claims will be apparent to those of skill in the art.

We claim:

1. A method for using a sacrificial anode in a marine propulsion system to prevent corrosion comprising insulating a propeller of said system from said anode by mounting a propeller of said system on a propeller shaft such that said propeller is not in electrical contact with said propeller shaft during periods of low thrust and can be in electrical contact with said propeller shaft during periods of high thrust.

2. A method according to claim 1 wherein said step of mounting comprises providing during said periods of low thrust an insulating gap between an inner cylinder of said propeller and a spacer for transferring thrust to said shaft and providing physical contact between said inner cylinder and said spacer during said periods of high thrust.

3. A marine drive unit comprising a propeller having an inner cylinder, a propeller shaft supporting said propeller, a cylindrical body in contact with said propeller shaft, damper means between said inner cylinder and said cylindrical body, a casing which supports said propeller shaft, a sacrificial anode in electrical contact with said casing, and spacer means on said propeller shaft for receiving thrust from said propeller, wherein said spacer means is not in contact with said inner cylinder during periods of low thrust and said spacer means can be in contact with said inner cylinder during periods of high thrust.

4. A drive unit according to claim 3 wherein said propeller shaft comprises an insulating material.

5. A drive unit according to claim 3 wherein said propeller includes an insulating surface coating.

6. A marine drive unit according to claim 3 wherein said damper means is made of electrically insulating material.

7. A marine drive unit according to claim 6 wherein said electrically insulating material is rubber.

8. A marine drive unit according to claim 3 wherein said spacer means comprises electrically insulating material.

9. A marine drive unit according to claim 8 wherein said insulating material comprises a ceramic coating.

* * * * *